US005108639A

United States Patent [19]

Block et al.

[11] Patent Number: 5,108,639

[45] Date of Patent: Apr. 28, 1992

[54] ELECTRORHEOLOGICAL FLUID CONTAINING A BASE-TREATED POLYANTHINE SOLID PHASE

[75] Inventors: Hermann Block, Cogenhoe; John Chapples, Bedford; Timothy Watson, Liverpool, all of England

[73] Assignee: National Research Development Corporation, England

[21] Appl. No.: 510,534

[22] Filed: Apr. 18, 1990

[30] Foreign Application Priority Data

Apr. 19, 1989 [GB] United Kingdom ..... 8908825

[51] Int. Cl.[5] ..... C09K 3/00; C10M 169/04; F16D 25/00

[52] U.S. Cl. ..... 252/77; 252/73; 252/572; 192/21.5

[58] Field of Search ..... 252/77, 73, 572, 575; 192/21.5

[56] References Cited

U.S. PATENT DOCUMENTS 3,984,339 10/1976 Takeo et al. .
4,687,589 8/1987 Block et al. ..... 252/73

FOREIGN PATENT DOCUMENTS 1501635 2/1978 United Kingdom .
1570234 6/1980 United Kingdom .
2100740 3/1985 United Kingdom .
2119392 7/1985 United Kingdom .
2153372 5/1987 United Kingdom .
2170510 10/1988 United Kingdom .

OTHER PUBLICATIONS

MacDiarmid et al., "Polyaniline: Interconversion of Metallic and Insulating Forms", Mol. Cryst. Liq. Cryst., vol. 121, pp. 173-180, 1985.
MacDiarmid et al.—pp. 248-249.
Salaneck et al—pp. 218-232.
Conducting Polymers, L. Alacer (ed.), R. Reidel Publishing Company 1987, pp. 105-120.
Huang et al., J. Chem Soc., Faraday Trans. 1, 1986, 82, 2385-2400.
MacDiarmid et al., Faraday Discuss, Chem Soc., 1989, 88, 317-332.
MacDiarmid et al, Synthetic Metals, 18 (1987) 285-290.
Chiang et al, Synthetic Metals, 13 (1986) 193-205.
Shenglong et al, "Polymerization of Substituted Aniline", Synthetic Metals, vol. 16, pp. 99-104, 1986.

*Primary Examiner*—Paul Lieberman
*Assistant Examiner*—Christine A. Skane
*Attorney, Agent, or Firm*—Rosenman & Colin

[57] ABSTRACT

An electrorheological fluid e.g. for selectively coupling clutch members consists of silicone oil containing 30 volume % of dispersed polyaniline. The polyaniline is acidically oxidised aniline subsequently treated with base.

18 Claims, No Drawings

ELECTRORHEOLOGICAL FLUID CONTAINING A BASE-TREATED POLYANTHINE SOLID PHASE

This invention relates to electrorheological fluid.

U.S. Pat. No. 2,417,850 (Winslow) discloses that certain suspensions, composed of a finely divided solid such as starch, limestone or its derivatives, gypsum, flour, gelatin or carbon, dispersed in a non-conducting liquid, for example lightweight transformer oil, transformer insulating fluids, olive oil or mineral oil, will manifest an increase in flow resistance as long as an electrical potential difference is applied thereto. This effect is sometimes termed the Winslow Effect. The increase in flow resistance resulting from the application of an electric field was originally interpreted as an increase in viscosity, and the materials showing this effect were termed 'Electroviscous Fluids'. However, subsequent investigations have shown that the increase in flow resistance may be due not only to an increase in viscosity, in the Newtonian sense, but also to an applied electric field induced Bingham plasticity; suspensions exhibiting the Winslow Effect are now referred to as 'Electrorheological Fluids'.

Research has been effected, and is being intensified, with a view to improving both the dispersed and the continuous phases of electrorheological fluids: see, for example, UK Patents Nos. 1501635; 1570234; and UK Patent Applications Nos. 2100740A; 2119392A and 2153372A. However, the mechanisms by which electrorheological phenomena occur are still not well understood; this lack of understanding and, in particular, the absence of a quantitative theory by which to determine the phenomena hamper the development of improved electrorheological fluids.

According to the present invention there is provided an electrorheological fluid which comprises a liquid continuous phase and at least one solids phase dispersed therein, which fluid is capable of functioning electrorheologically when substantially anhydrous, characterised in that the solids phase comprises a polyaniline treated with base.

By "anhydrous" is meant herein, in practice, in relation to the or each dispersed phase, that the phase, after excess reagent removal, is dried in air and then under vacuum at 20° C.–40° C. for 24 hours; and, in relation to the continuous phase, that the phase is dried over a molecular sieve.

The invention extends to a device such as a clutch, valve or damper containing the electrorheological fluid set forth above. In a preferred clutch or damper, the fluid extends between two movable members subject to different moving forces, there being means for applying a potential across the fluid for coupling the members when required.

It is known from UK Patent GB 2170510B that in an electrorheological fluid, the dispersed phase advantageously comprises an electronic organic semiconductor, through which electricity is conducted by means of electrons (or holes) rather than by means of ions, having an electrical conductivity, at ambient temperature, from $10^{\circ}$ mho $cm^{-1}$ to $10^{-11}$ mho $cm^{-1}$, for example from $10^{-2}$ mho $cm^{-1}$ to $10^{-10}$ mho $cm^{-1}$, typically from $10^{-4}$ mho $cm^{-1}$ to $10^{-9}$ mho $cm^{-1}$, and a positive temperature-conductivity coefficient. A particularly preferred organic semiconductor was said to be an aromatic fused polycyclic system comprising a nitrogen or an oxygen hetero atom.

Although polyaniline is chemically different from the fused polycyclic system referred to above, it is a conducting polymer which in the unmodified emaraldine form obtained by acidic e.g. persulphate oxidation of aniline has a conductance of 10 S/cm. In this form it is an unpromising system for use in ER formulations. Treatment by base of the emaraldine form of polyaniline reduces its conductivity and generates the forms of polyaniline upon which the examples herein are based. Aqueous ammonia, alkalis such as aqueous NaOH, or other bases, can be used. The base is preferably aqueous ammonia of density under 0.94, more preferably under 0.92 g/$cm^3$, preferably at least 0.9 g/$cm^3$, e.g. 0.91 g/$cm^3$, with a treatment time of from 10 to 120 minutes, preferably 60 minutes.

The base may be derived from ammonia by appropriate dilution or may be a metal compound e.g. hydroxide and is preferably applied in aqueous solution of 0.5M–10M, preferably 1M–5M, for from 1 to 100 minutes, preferably 4 to 20 minutes.

Examples of suitable continuous phase material include fluid hydrocarbons or those disclosed in our UK Patents Nos. 1501635; 1570234 or UK patent Application No. 2100740A and 2153372A. Halogenated aromatic liquids are particularly preferred continuous phase materials. Silicone oil of say 100 cS may also be used.

The electrorheological fluids of this invention are prepared by simply comminuting the dispersed phase to the requisite particle size; and then mixing the comminuted dispersed phase with the selected continuous phase. The "requisite" size is simply a size which is small (e.g. under 10%) of the intended interelectrode spacing; thus, in typical applications, particles may be comminuted to below 50 μm (e.g. 10–30 μm). Loadings of as little as 5% v/v, or even 1% v/v, of dispersed phase may give an effect, although loadings of at least 15% v/v to 45% v/v, especially from 25% v/v, 35% v/v, are preferred for commercial electrorheological fluids.

The invention will now be described by way of example.

Ammonium persulphate [$(NH_4)_2S_2O_8$, 278.8 g, 1.2 mol] was added to 1500 ml of stirred 2M hydrochloric acid solution in a large beaker. Once the persulphate had dissolved, the continuously stirred solution was cooled to between 0° and 5° C. and aniline ($C_6H_5NH_2$, 111.8 g, 1.2 mol) was slowly added ensuring that the temperature was kept below 5° C. The resultant black mixture was stirred for 24 hrs. It was then filtered and washed very thoroughly with 2M hydrochloric acid. The black solid was then put in a vacuum oven at room temperature and continuously pumped until dry. The solid was ground to a powder and put through a 100 μm sieve.

1.75 g samples of the powder were treated in 50 ml of 2M aqueous sodium hydroxide for (Example A) 5 mins, (Example B) 1 hour, and (Example C) 24 hours. The samples were filtered and washed with deionised water and again dried in the vacuum oven at room temperature. These three samples were tested on a static yield stress rig as 20% volume fractions in a polychlorinated hydrocarbon "CERECLOR 50 LV" ex ICI plc at 20° C. Table 1 shows the yield stress at various electric fields (and the currents flowing in some cases) and Table 2 shows the currents flowing at the lower electric fields.

In Table 3, further samples of the powder were treated as above for 5, 15 and 30 minutes, and as there was some scatter, the second-best of four is reported in each case. Table 3 shows the static yield stresses of the samples as 20% dispersions in 'Cereclor' at room temperature. The density of the polyaniline was assumed to be 1.5 $gcm^{-3}$.

The yield stress figures are subject to an experimental error of about 10–20% in the method of measurement.

TABLE 1

| Electric Field ($V\ mm^{-1}$) | YIELD STRESS (Pa) Example A | Example B | Example C |
|---|---|---|---|
| 800 | 90 | 90 | 20 |
| 1600 | 770 | 670 | 340 |
| 2400 | 1620 | 1120 | 920 |
| 3200 | 2550 (0.005 mA, 1.25 $\mu A/cm^2$) | 1820 (0.005 mA, 1.25 $\mu A/cm^2$) | 1280 |
| 3600 | 3480 (0.005 mA, 1.25 $\mu A/cm^2$) | — | — |
| 4000 | 5080 (0.01 mA, 2.5 $\mu A/cm^2$) | 3180 (0.01 mA, 2.5 $\mu A/cm^2$) | 1920 |

The gap between the movable plates in the test cell is 0.5 mm—the cell area is 4 $cm^2$.

TABLE 2

| Voltage (V) and Field | Current flow at various electric fields: Example A (17° C.) Current ($\mu A$) C't Density | Example B (19° C.) Current ($\mu A$) C't Density | Example C (20° C.) Current ($\mu A$) C't Density |
|---|---|---|---|
| 100 | 0.09 | 0.13 | 0.11 |
| 200 $V\ mm^{-1}$ | 0.023 $\mu A\ cm^{-2}$ | 0.033 $\mu A\ cm^{-2}$ | 0.0275 $\mu A\ cm^{-2}$ |
| 200 | 0.18 | 0.21 | 0.18 |
| 400 $V\ mm^{-1}$ | 0.045 $\mu A\ cm^{-2}$ | 0.053 $\mu A\ cm^{-2}$ | 0.045 $\mu A\ cm^{-2}$ |
| 300 | 0.29 | 0.32 | 0.26 |
| 600 $V\ mm^{-1}$ | 0.073 $\mu A\ cm^{-2}$ | 0.08 $\mu A\ cm^{-2}$ | 0.065 $\mu A\ cm^{-2}$ |
| 400 | 0.42 | 0.48 | 0.36 |
| 800 $V\ mm^{-1}$ | 0.105 $\mu A\ cm^{-2}$ | 0.12 $\mu A\ cm^{-2}$ | 0.09 $\mu A\ cm^{-2}$ |
| 500 | 0.60 | 0.68 | 0.48 |
| 1000 $V\ mm^{-1}$ | 0.15 $\mu A\ cm^{-2}$ | 0.17 $\mu A\ cm^{-2}$ | 0.12 $\mu A\ cm^{-2}$ |
| 600 | 0.83 | 0.94 | 0.60 |
| 1200 $V\ mm^{-1}$ | 0.21 $\mu A\ cm^{-2}$ | 0.235 $\mu A\ cm^{-2}$ | 0.15 $\mu A\ cm^{-2}$ |
| 700 | 1.11 | 1.24 | 0.75 |
| 1400 $V\ mm^{-1}$ | 0.278 $\mu A\ cm^{-2}$ | 0.31 $\mu A\ cm^{-2}$ | 0.188 $\mu A\ cm^{-2}$ |
| 800 | 1.45 | 1.59 | 0.94 |
| 1600 $V\ mm^{-1}$ | 0.363 $\mu A\ cm^{-2}$ | 0.398 $\mu A\ cm^{-2}$ | 0.235 $\mu A\ cm^{-2}$ |
| 900 | 1.84 | 1.99 | 1.18 |
| 1800 $V\ mm^{-1}$ | 0.46 $\mu A\ cm^{-2}$ | 0.498 $\mu A\ cm^{-2}$ | 0.295 $\mu A\ cm^{-2}$ |
| 1000 | 2.28 | 2.43 | 1.46 |
| 2000 $V\ mm^{-1}$ | 0.57 $\mu A\ cm^{-2}$ | 0.608 $\mu A\ cm^{-2}$ | 0.365 $\mu A\ cm^{-2}$ |

The test cell was as in Table 1.

TABLE 3

Alkali Treated Polyaniline 20% volume fraction in dry Cereclor
Static Yield Stress (Pa)
(with Current Density ($\mu A/cm^2$) in brackets)

| Electric Field ($V\ mm^{-1}$) | 5 minutes in 2M NaOH | 15 minutes in 2M NaOH | 30 minutes in 2M NaOH |
|---|---|---|---|
| 800 | 200 ± 60 (1.25) | 170 ± 40 (<1.25) | 110 ± 60 (1.25) |
| 1600 | 670 ± 80 (2.5) | 820 ± 80 (1.25) | 275 ± 90 (1.25) |
| 2400 | 1210 ± 60 (5.0) | 1100 ± 80 (2.5) | 460 ± 45 (3.75) |
| 3200 | 1830 ± 100 (10) | 1860 ± 280 (2.5) | 550 (5) |
| 3600 | 2340 ± 400 (15) | 2150 ± 220 (3.75) | — — |
| 4000 | 2960 ± 160 (17.5) | 1960 ± 190 (10) | — — |

6 g samples of the powder made from aniline and persulphate as previously described were treated with 100 ml of aqueous ammonia (0.910 $g/cm^3$) for 60 mins. The material was filtered and dried firstly in air and then in the vacuum oven at room temperature. Samples were tested on a static yield stress rig as (Example D) a 30% volume fraction in silicone oil at 18.5° C. and as (Example E) a 30% volume fraction in "CERECLOR 50 LC" ex ICI plc at 21° C. Table 4 shows the yield stress and current densities for the silicone dispersed material and Table 5 the yield stress and current densities for the "CERECLOR 50 LV" dispersed material, both as a function of applied electric fields. The density of the polyaniline was assumed to be 1.5 $g/cm^3$.

TABLE 4

EXAMPLE D: Ammonia-treated poly(aniline) at a 30% vol. fraction in silicone oil at 18.5° C.

| Electric field/$V\ mm^{-1}$ | Static yield stress/Pa | Current density/$\mu A\ cm^{-2}$ |
|---|---|---|
| 800 | 200 | 0.04 |
| 1600 | 500 | 0.13 |
| 2400 | 950 | 0.28 |
| 3200 | 1540 | 0.75 |
| 4000 | 2400 | 1.25 |

TABLE 5

EXAMPLE E: Ammonia-treated poly(aniline) at a 30% vol. fraction in CERECLOR at 21° C.

| Electric field/$V\ mm^{-1}$ | Static yield stress/Pa | Current density/$\mu A\ cm^{-2}$ |
|---|---|---|
| 800 | 25 | 0.5 |
| 1600 | 500 | 1.6 |
| 2400 | 3500 | 3.5 |
| 3200 | 3500 | 5.5 |
| 4000 | 4900 | 8.0 |

We claim:

1. An electrorheological fluid which comprises a liquid continuous phase and at least 1 volume percent of at least one solids phase dispersed therein, which fluid is capable of functioning electrorheologically when substantially anhydrous, characterised in that the solids phase comprises a polyaniline treated with base and having an electrical conductivity, at ambient temperature, of from $10^{-4}$ to $10^{-9}$ mho $cm^{-1}$.

2. An electrorheological fluid according to claim 1, wherein the base with which the polyaniline was treated is aqueous ammonia or alkali.

3. An electrorheological fluid according to claim 2, wherein the base was aqueous ammonia of density under 0.94 $g/cm^3$.

4. An electrorheological fluid according to claim 3 wherein the base was aqueous ammonia of density under 0.92 $g/cm^3$.

5. An electrorheological fluid according to claim 2, wherein the base was aqueous ammonia of density at least 0.90 $g/cm^3$.

6. An electrorheological fluid according to claim 1, wherein the treatment time of the polyaniline with the base was 10 to 120 minutes.

7. An electrorheological fluid according to claim 1, wherein the base was a metal compound.

8. An electrorheological fluid according to claim 7, wherein the compound was a hydroxide.

9. An electrorheological fluid according to claim 7, wherein the compound was applied in aqueous solution.

10. An electrorheological fluid according to claims 7, wherein the compound was applied in a solution of concentration 0.5M–10M.

11. An electrorheological fluid according to claim 10, wherein the compound was applied in a solution of concentration 1M–5M.

12. An electrorheological fluid according to claim 7, wherein the treatment of the polyaniline with the base was from 1 to 100 minutes.

13. An electrorheological fluid according to claim 12 wherein the treatment of the polyaniline with the base was from 4 to 20 minutes.

14. An electrorheological fluid according to claim 1, wherein the liquid continuous phase is a fluid hydrocarbon, a halogenated aromatic liquid or silicone oil.

15. An electrorheological fluid according to claim 1, wherein the solids phase is from 15 to 45 volume % of the fluid.

16. An electrorheological fluid according to claim 15, wherein the solids phase is from 25 to 35 volume % of the fluid.

17. A clutch, valve or damper containing an electrorheological fluid according to claim 1.

18. A clutch or damper according to claim 17, wherein the fluid extends between two movable members subject to different moving forces, there being means for applying a potential across the fluid for coupling the members when required.

* * * * *